United States Patent [19]

Chesnut

[11] Patent Number: 4,811,510

[45] Date of Patent: Mar. 14, 1989

[54] CARTRIDGE MAGAZINE AND METHOD FOR INCREASING NUMBER OF STORED CARTRIDGES

[76] Inventor: M. Gaines Chesnut, 1171 Barlow Dr., Kremmling, Colo. 80459

[21] Appl. No.: 107,484

[22] Filed: Oct. 8, 1987

[51] Int. Cl.[4] ..... F41C 25/02

[52] U.S. Cl. ..... 42/50; 42/7

[58] Field of Search ..... 42/7, 18, 22, 50

[56] References Cited

U.S. PATENT DOCUMENTS

| | | | |
|---|---|---|---|
| 283,122 | 8/1883 | Lewis | 42/50 |
| 303,992 | 8/1884 | Diss | 42/50 |
| 304,008 | 8/1884 | Krug | 42/50 |
| 313,856 | 3/1885 | Diss | 42/50 |
| 431,410 | 7/1890 | Speed | 42/50 |
| 562,455 | 6/1896 | Bye | 42/7 |
| 1,200,685 | 10/1916 | Young | 42/7 |
| 2,777,235 | 1/1957 | Hopkins | 42/50 |
| 2,828,568 | 4/1958 | Sakewitz | 42/7 |
| 4,343,107 | 8/1982 | Kaltenegger | 42/7 |
| 4,446,645 | 5/1984 | Kelsey, Jr. et al. | 42/50 |
| 4,509,283 | 4/1985 | Chesnut | 42/50 |

*Primary Examiner*—Charles T. Jordan

*Attorney, Agent, or Firm*—Sheridan, Ross & McIntosh

[57] ABSTRACT

A firearm cartridge magazine which holds a larger number of cartridges than corresponding magazines of existing design but without changes in the external size of the magazine is provided. A spring for moving the follower is run out of attenuated when the follower is in the lowest position so that, in the lowest follower position, the spring extends below the follower a distance less than about the diameter of a cartridge, and preferably about one thickness of the follower spring. A device for storing energy is provided to assist in lifting the follower from the lowermost position. Preferably, the device for storing energy is in the form of one or more follower legs which are spring-urged towards an unfolded or extended position. Preferably, the legs themselves are resilient so as to form leaf-type springs. When the follower is moved to the lowest position, energy is stored by folding or compressing the spring-loaded legs. Because of the folding or compression of the follower legs, the follower requires less volume in its lowermost position which further assists in accommodating additional cartridges.

21 Claims, 7 Drawing Sheets

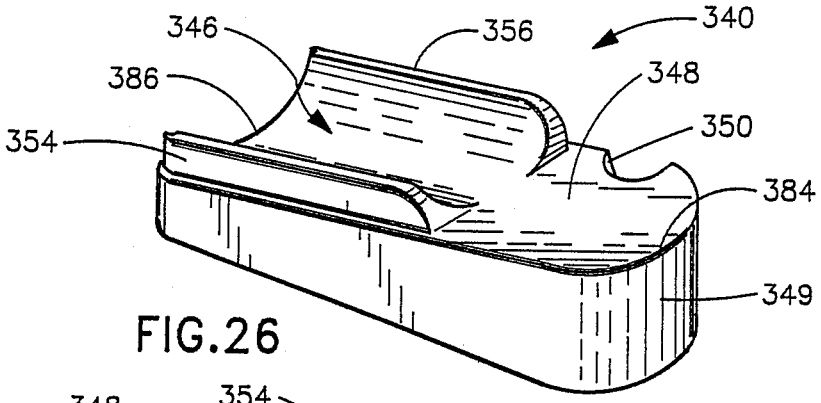
FIG.26
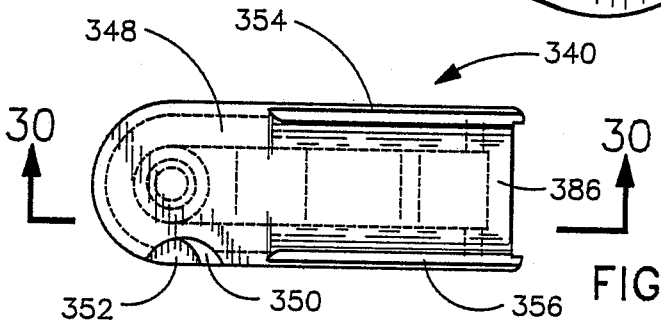
FIG.27
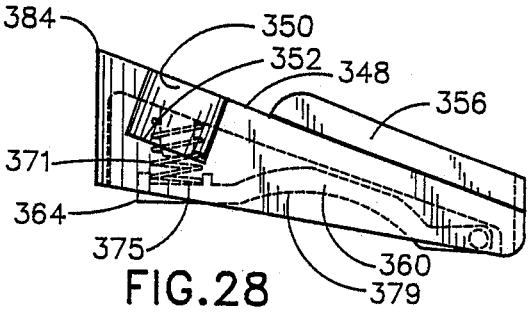
FIG.28
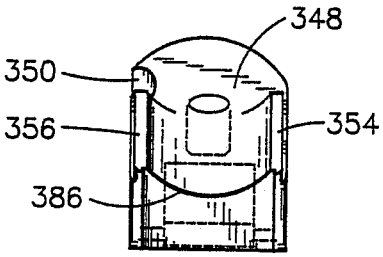
FIG.29
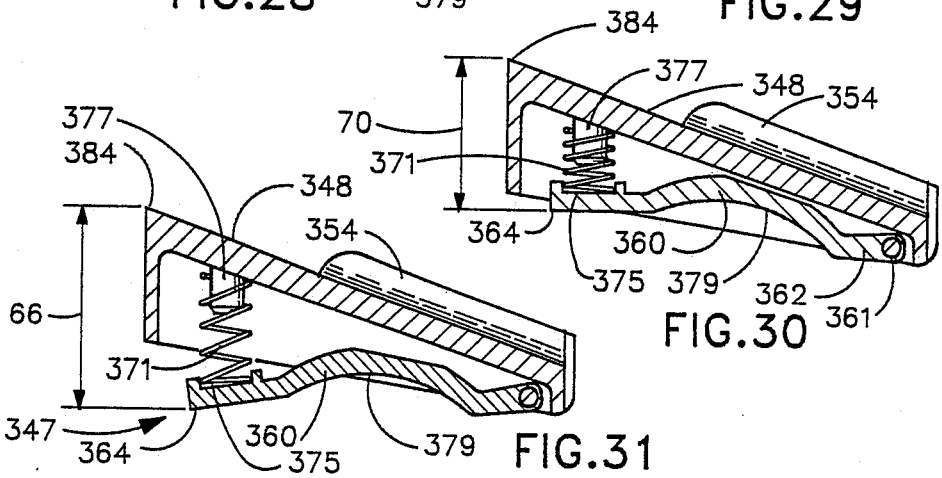
FIG.30
FIG.31

CARTRIDGE MAGAZINE AND METHOD FOR INCREASING NUMBER OF STORED CARTRIDGES

FIELD OF THE INVENTION

This invention relates to magazines for storing firearm cartridges and, in particular, to a magazine and follower and a method for increasing the number of cartridges which can be stored in a magazine without substantially changing the exterior configuration of the magazine.

BACKGROUND INFORMATION

Cartridge magazines which are used for providing a plurality of cartridges to firearms are typically designed to have a predetermined cartridge capacity. After expending the rounds stored in the magazine, the depleted magazine must be replaced with a loaded magazine before continuing to fire the firearm.

By providing a magazine which is able to store a larger number of cartridges as compared to previous magazines, convenience of use of the firearm is increased because less frequent magazine changes will be required. Furthermore, such larger capacity magazines are useful in firearm competition, hunting and other sport uses of firearms to permit the firing of increased number of round before replacement of the magazine becomes necessary. Further, an increased number of cartridges in a magazine is useful in military, police and other law enforcement contexts where the ability to fire even a single additional round without reloading can be of vital importance in many situations.

One method of increasing the cartridge capacity of a magazine would be to simply make the magazine larger, i.e. longer, wider or deeper. However, most such changes require corresponding modifications of the firearm with attendant expense and inconvenience. Thus, it would be preferred to increase the cartridge capacity of the magazine without substantially changing the external configuration of the magazine so that no substantial modification of the firearm is required. In this way, the improved magazine can simply be inserted into the firearm in the same manner as the previous types of magazines were inserted.

An additional reason for preserving the external configuration of the magazine is that certain firearm competitions specify, in their rules, the types of magazines which are permitted. Thus, in many such competitions, magazines with a changed external configuration could not be legally employed. For example, the I.P.S.C. International and U.S. Shooting Rules require that "[t]he magazine used may not extend beyond the butt of the weapon. To qualify this statement, the base plate of the magazine must be within the confines of the butt." Thus, it would be useful to provide a 0.45 magazine which can store more than the eight rounds which are stored by previous 0.45 magazines but which complies with the I.P.S.C. Rules.

Portions of the following describe the present invention as applied to a 0.45 magazine and particularly a 0.45 magazine intended for use in compliance with the I.P.S.C. International and U.S. Shooting Rules. As will be apparent, however, the concepts and principles embodied in the present invention, sometimes with certain modifications, can be used in a wide variety of magazines, including magazines intended for use with bolt action as well as automatic weapons, multiple column as well as single column magazines, and rifles and other firearms as well as hand guns.

In order to provide for a larger number of cartridges, preferably without modifying the exterior configuration of the magazine, it is useful to modify aspects of the interior configuration of the magazine. Some magazines are provided with a follower spring which exclusively resides below the follower. Such a spring is illustrated in U.S. Pat. No. 4,446,645, issued May 8, 1984 to Kelsey, Jr., et al., which discloses making the cartridge follower resilient independently of the follower spring so that this spring action of the follower itself compliments that of the follower spring. Kelsey, Jr. states that the total force exerted by the combined action of the follower and follower spring in unison can greatly enhance the function of the magazine in delivering the cartridges. Kelsey, therefore, was able to provide additional space within the magazine by employing a follower spring having a reduced solid height (and reduced force) and thereby to increase the number of rounds storable in the cartridge from seven to eight. However, the configuration disclosed by Kelsey still requires an irreducible amount of space between the follower and the bottom plate because of the necessity for a storage space for the compressed spring and the necessity for a rear leg or "guide tab" to guide the follower which also occupies space below the follower surface.

Another approach to providing a spring for moving the follower is disclosed in U.S. Pat. No. 2,777,235, issued Jan. 15, 1957 to Hopkins. Hopkins discloses springs constructed to apply a substantially constant force to the cartridges in the removal position. The springs extend in a spiral configuration beneath the follower to be fully coiled when the magazine is empty and to be attenuated to occupy "minimum" space within the magazine when the magazine is full of cartridges. However, Hopkins, similarly to Kelsey, discloses an irreducible amount of space between the follower and the bottom surface of the magazine because Hopkins discloses that even when the magazine is full of cartridges, at least one coil or diameter of the spring extends below the follower. Further, Hopkins discloses a follower having a skirt which occupies space below the follower surface.

Merely, removing the skirt and further attenuating the spring of Hopkins has been found unsatisfactory because removal of the skirt leaves the follower susceptible to rotating or tilting which leads to jamming. Further, merely removing the skirt of Hopkins is unsatisfactory in particular types of magazines because in certain types of magazines, the follower performs a number of functions other than merely moving the cartridges. In a 0.45 magazine, for example, the follower, in addition to having features for preventing rotation of the follower, has features for activating a bolt or slide hold-open mechanism of the firearm at a desired time, has features for assuring that the bolt or slide will not tend to eject the follower from the magazine, and has features to orient and hold the topmost cartridge at a desired angle. Thus, any modification of the 0.45 follower must also provide for performance of the additional functions of the follower.

Complete attenuation of a spring such as that in Hopkins, without further changes, has been found unsatisfactory in many cases because the fully stretched spring may not always move into the desired spiral configuration underneath the follower as the follower moves upward. Further, the attenuated spring creates a force on the follower which acts in a direction substantially different from the upward direction, and usually acts to move the follower towards one of the end or side walls. Both the tendency to not assume the desired coil configuration and the tendency to apply force towards a side or end wall leads to loss of spring lifting power. Loss of spring lifting power is made even more serious by providing an additional cartridge and thus additional weight which must be lifted, e.g., as in increasing the number of 0.45 cartridges from eight to nine.

SUMMARY OF THE INVENTION

According to the present invention, the number of cartridges provided in a magazine can be increased over the number provided in corresponding conventional magazines by using one or both of two aspects of the invention.

The first aspect involves a spring for moving the follower. The spring has a length, width and thickness. This aspect of the invention involves providing a spring which, when the follower is in the lowest position, extends below the follower a distance less than about the diameter of a cartridge and preferably a distance about equal to the thickness of the spring. In this manner, an additional cartridge diameter can be fitted into the magazine. Where such runout or attenuation of the spring results in difficulty of lifting the column of cartridges, particularly out of the lowermost position, an additional spring, preferably attached to or part of the follower, is used. A spring can also be provided which is attached to a part of the magazine such as being attached to a point of the bottom wall or base plate. When the proper coiling of the spring upon upward movement of the follower presents difficulties, proper coiling is assisted by providing a tip or bent portion projecting at an angle from the end of the spring.

The second aspect involves providing a follower which is in a normal or expanded configuration during part of the movement through the magazine but which is in a folded or collapsed state when the follower is adjacent to the bottom end of the magazine. By providing legs which unfold or expand when the follower moves out of its lowermost position, the leg or legs can be used to stabilize the follower against over-rotation and to prevent stripping the follower from the magazine. However, the volume normally required by the legs in the expanded position is recovered when the follower moves to the lowermost position thus providing part or all of the volume necessary for one or more additional cartridges at a time when rotation of the follower and stripping of the follower from the magazine are not primary concerns.

The follower of this aspect of the invention also contains a bolt or slide hold-open which is preferably attached to one of the collapsable legs. The bolt/slide hold-open can also be attached to other parts of the follower, such as the upper structure of the follower. In this manner, the hold-open is available and properly positioned when the last cartridge is removed from the magazine.

In view of the foregoing description, a number of advantages of the present invention are readily discernible. A cartridge magazine and follower is provided for holding more than the conventional number of cartridges without the necessity for changing the exterior configuration or length of the magazine. As a consequence, the frequency with which magazines must be changed is decreased. In some configurations, the follower can be formed at least partly by cutting and bending sheet stock, thus reducing manufacturing expense. Some of the configurations are conveniently formed from plastics, such as by injection molding. The follower is stabilized against over-rotation and thus is effective to reduce or eliminate jamming caused by such an over-rotation. The follower is protected against stripping of the follower from the magazine by the bolt or slide of the firearm. The follower is provided with a bolt hold-open device which is properly positioned as the follower moves towards the opened end of the cartridge. The spring for moving the follower occupies very little space below the follower when the follower is in the lowermost position and yet is able to assume the desired spiral configuration which defines a generally circular perimeter as the follower moves upward. The magazine provides sufficient force to the follower that the follower can be lifted from its lowermost position upon removal of the first cartridge from the magazine even though such movement requires the follower to lift a larger number of cartridges than was necessary for the corresponding movement in previous magazines.

BRIEF DESCRIPTION OF THE DRAWINGS

FIG. 26 is a perspective view of a fourth embodiment of a follower according to the present invention;

FIG. 27 is a top plan view of the follower of FIG. 26;

FIG. 28 is a side elevational view of the follower of FIG. 26;

FIG. 29 is a rear elevational view of the follower of FIG. 26;

FIG. 30 is a cross-section of the follower taken along line 30—30 of FIG. 27;

FIG. 31 is a side elevational view similar to FIG. 28, but showing the follower in an expanded configuration;

DETAILED DESCRIPTION

Figure 1:
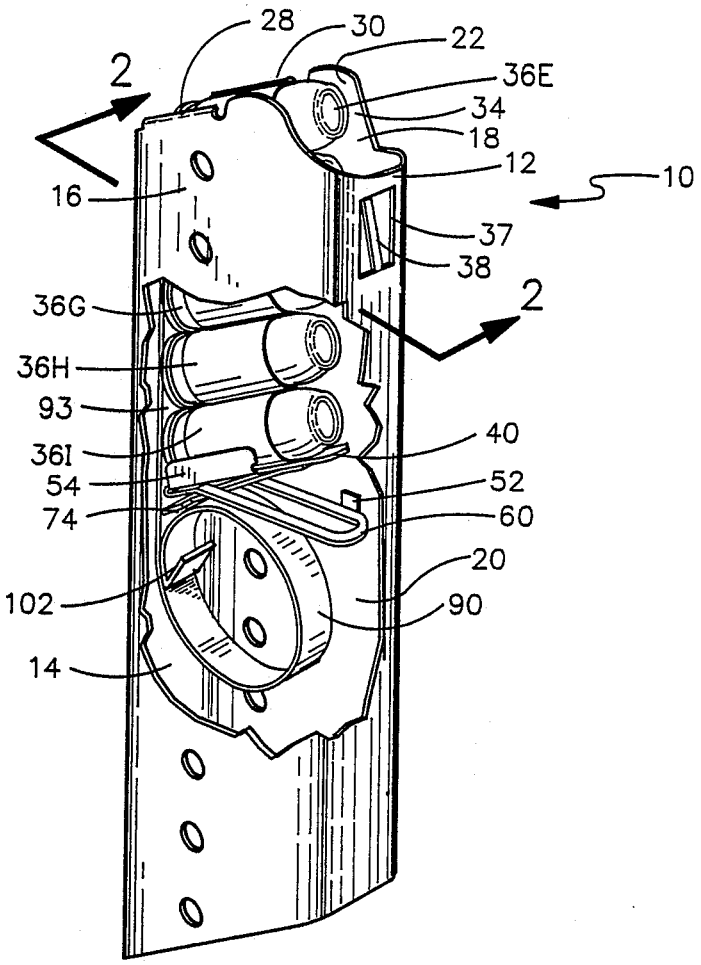
FIG. 1 is a perspective view of a magazine according to the present invention depicting five cartridges inserted and with a portion broken away to show a follower and spring in an intermediate position.

The magazine and follower of the present invention provides for a very small extent of a follower spring below the follower in the lowest follower position and provides for folding or collapsability of the follower in the lowest position. FIG. 1 shows a magazine 10 which, for purposes of illustration only, is of a type usable with a 0.45 caliber hand gun. The magazine 10 includes a first or front end wall 12, which, in the 0.45 embodiment has a curved contour, and a second end wall or back wall 14. The magazine 10 also includes a first and a second side wall 16, 18. The end walls 12, 14 and side walls 16, 18 define a chamber 20. The chamber 20 has a top or opened end 22 and a bottom end 24 preferably covered by a bottom wall 26. The opened end 22 is partly covered by inwardly curving lips 28, 30. The front wall 12 in the region near the opened end 22 is cut away to provide an escape opening 34 through which the cartridges 36A–36I are removed in a serial fashion.

A hole 37 is provided in the front wall 12 and a leaf spring 38 is attached to the front wall 12 such as by spot welding to extend through the hole 37 and into the chamber 20 for positioning the cartridges 36A–36I, as described more fully below.

Figure 3:
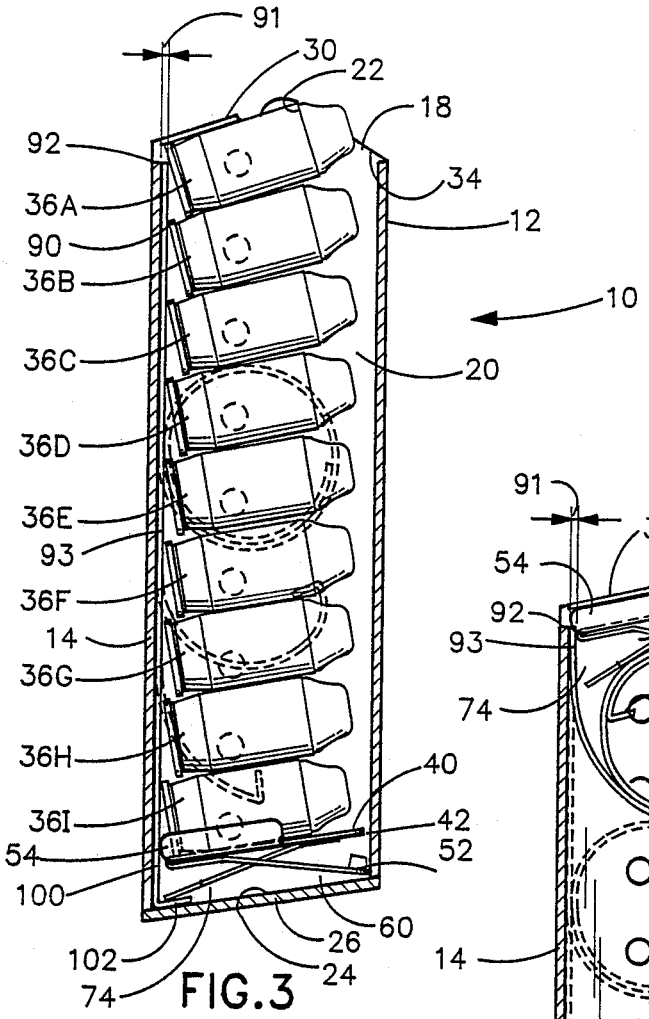
FIG. 3 is a cross-sectional view similar to the view of FIG. 2 but showing the follower in its lowermost position.
Figure 4:
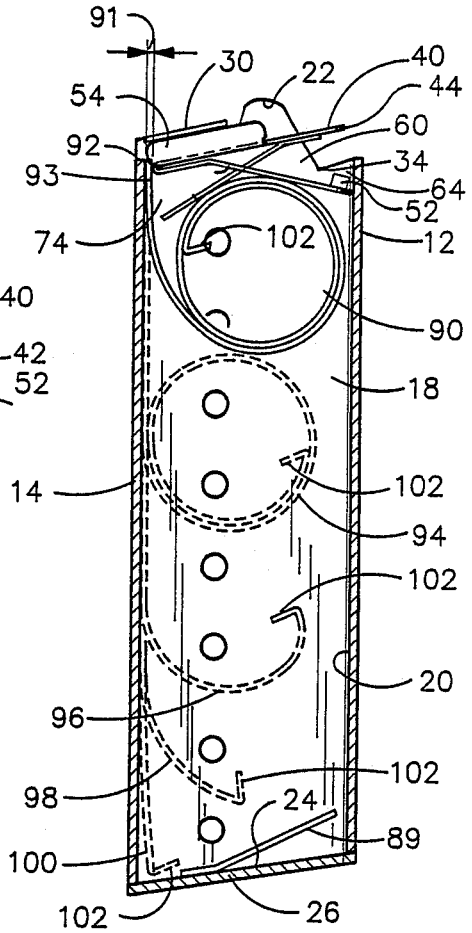
FIG. 4 is a cross-sectional view similar to the view of FIG. 2 but showing the follower in its uppermost position and showing a spring attached to the bottom end.

A follower 40 is mounted in the chamber 20 for movement between a first position 44, best seen in FIG. 4, and a second position 42, shown in FIG. 3. The first position 44 is adjacent to the opened end 22 of the magazine and the second position 42 is adjacent to the bottom end 24 of the magazine 10.

The follower of the present invention is provided with features which are useful in producing the results described herein. Followers having these features can be produced in a number of embodiments, some of which are illustrated in FIGS. 5 through 31. The embodiment depicted in FIGS. 4–9 will be referred to in connection with describing certain features of the follower of this invention, many of such features being common to all illustrated embodiments, as well as other embodiments which can be provided and modifications thereof.

Figure 5:
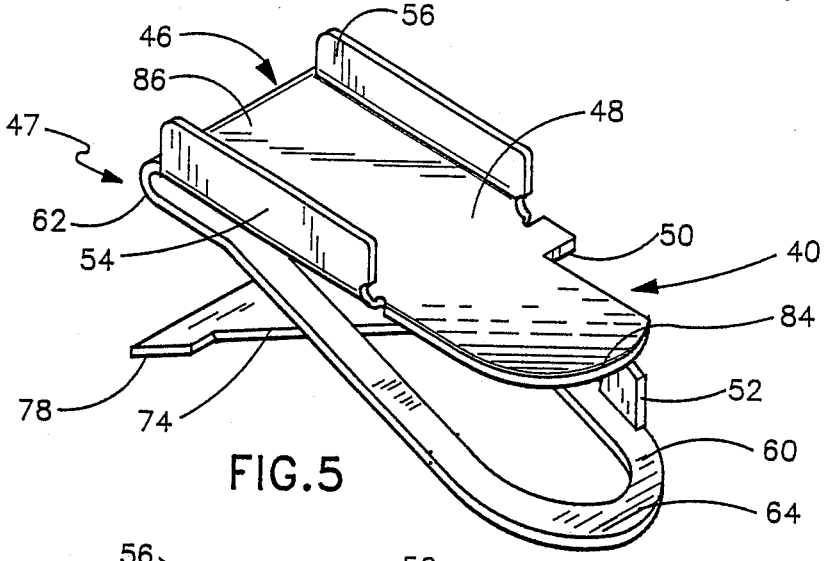
FIG. 5 is a perspective view of a first embodiment of a follower according to the present invention.
Figure 6:
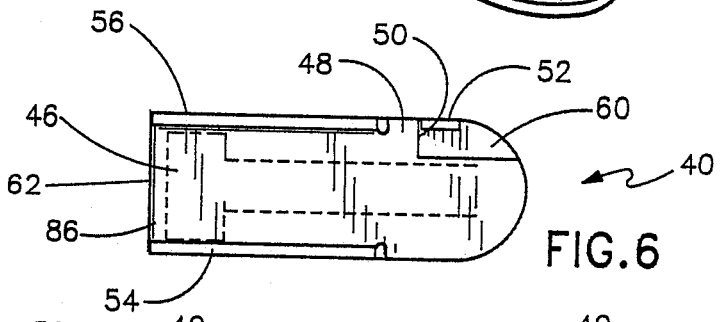
FIG. 6 is a top plan view of the follower of FIG. 5.
Figure 7:
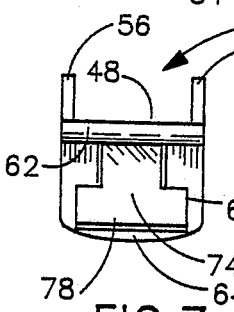
FIG. 7 is a rear elevational view of the follower of FIG. 5.

As best illustrated in FIG. 5, the follower 40 according to a first embodiment includes an upper structure 46 for supporting a cartridge 36I and a lower structure 47. The upper structure 46 includes a cartridge contact surface 48 which contacts the lowermost cartridge 36I. The lower structure 47 is that part of the follower which is below the points where the legs 60, 74 are attached. The cartridge contact surface 48 can, in general, cover an area similar to a horizontal cross-section through the magazine 10. However, it is preferred that the cartridge contact surface 48 be provided with a cut-out area 50 in the region of the cartridge contact surface 48 which is near the juncture of the front wall 12 and second side wall 18. This cut-out 50 provides for clearance of the cartridge contact surface 48 as it moves upward past the bolt or slide hold-open lever of the firearm (not shown) so that the cartridge contact surface 48 will not activate the bolt/slide hold-open lever.

A bolt/slide hold-open 52 is attached to the follower 40 in a position to activate the bolt hold-open lever of the firearm (not shown) when the follower 40 moves to the first position 44. The bolt/slide holdopen 52 is preferably attached to the front leg 60 of the follower 40 directly below the cut-out 50 of the cartridge contact surface 48. The height of the bolt hold-open 52 is selected so that the bolt hold-open 52 is in a position to activate the bolt/slide hold-open lever when the follower 40 moves to the first follower position 44.

Figure 34:
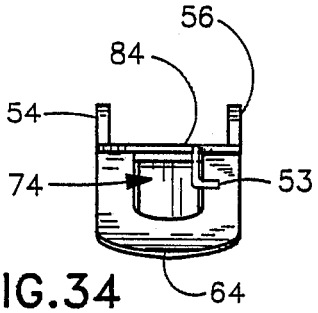
FIG. 34 is a front elevational view of a follower according to the present invention depicting an alternative configuration of the bolt/slide hold-open.
Figure 35:
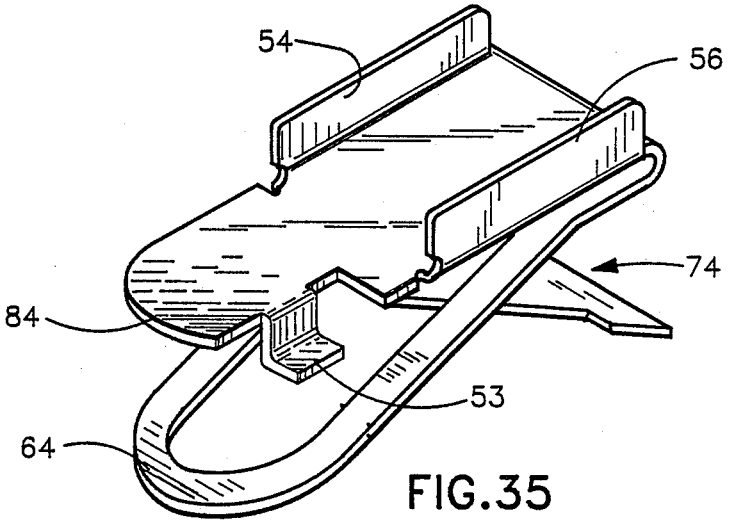
FIG. 35 is a perspective view of the embodiment of FIG. 34.

Depicted in FIGS. 34 and 35 is another form for a bolt/slide hold-open 53 which, in this case, is formed by bending a portion of the cartridge contact surface 48 downward and outward to form a descending step-like structure 53. This structure and method of formation, although depicted in conjunction with the first follower embodiment depicted in FIGS. 5–11, can also be used in conjunction with the other follower embodiments depicted in FIGS. 12–31.

Extending upward from the cartridge contact surface 48 are first and second ears 54, 56. The ears 54, 56 are located on the cartridge contact surface 48 in a position such that when the follower approaches the first position 44 shown in FIG. 4, the ears 54, 56 will contact the lips 28, 30, respectively, of the magazine 10. The ears 54, 56 act to prevent movement of the follower 40 any closer to the opened end 22 than a predetermined distance related to the height 58 of the ears 54, 56. The height 58 is selected so that at the first position 44 the front leg 60 of the follower 40 will remain below the front wall escape opening 34. If the follower 40 in the first position 44 were permitted to rise to a level at which the front leg 60 was at or above the front wall escape opening 34, it would be possible for the bolt or slide of the firearm to engage the follower 40 and move it partly or fully out of the magazine 10, i.e. to strip the follower 40 from the magazine 10. By providing ears 54, 56 of sufficient height 58, the front leg 60 is maintained below the escape opening 34 of the front wall 12 and thus the front leg 60 is able to bear against the front wall 12 to prevent movement of the follower 40 through the escape opening 34. It has been found that in a 0.45 caliber magazine, a height 58 of about ½ to ⅓ the diameter of a cartridge 36 will be effective to properly position the front leg 60 with respect to the cut-out 34.

The front let 60 has a first end 62 which is attached to the upper structure 46. In the embodiment shown in FIGS. 5–18, the first end 62 is continuous and integral with the upper structure 46 and is formed by bending the front leg 60 from an originally flat configuration.

The front leg 60 has a second or free end 64. The front leg 60 is movable, with respect to the upper structure 46, from a position such as that shown in FIG. 8 in which the free end 64 of the front leg 60 is spaced a distance 66 from the cartridge contact surface 48 to a second position, illustrated in FIG. 11. In the second position, the front leg 60 is substantially adjacent to the cartridge contact surface 48 and the free end 64 of the front leg 60 is positioned a second distance 70 away from the cartridge contact surface 48. The second distance 70 is less than the first distance 66.

A second or rear leg 74 has a first end 76 attached to or integral with the upper structure 46 and a free end 78. In the embodiment depicted in FIGS. 5–18, the first end 76 is attached by welding, riveting or the like. The first end 76 can also be continuous and integral with the upper structure 46, such as by forming by bending the rear leg 74 from an originally flat configuration (not shown). The second leg 74 is movable from a first leg position, illustrated in FIG. 8, in which the free end 78 is spaced a distance 80 from the cartridge contact surface 48, to a second position substantially adjacent to the cartridge contact surface 48, illustrated in FIG. 11. When the second leg 74 is in the second position, shown in FIG. 11, the free end 78 of the second leg 74 is spaced a distance 82 from the cartridge contact surface 48. The distance 82 is less than the distance 80.

Figure 8:
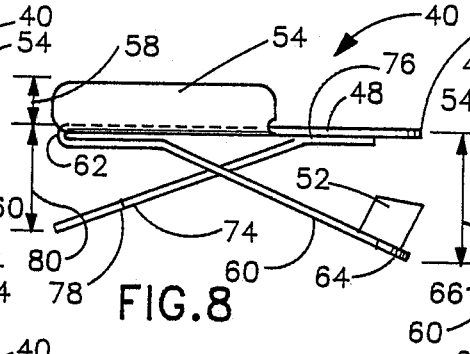
FIG. 8 is a side elevational view of the follower of FIG. 5.
Figure 9:
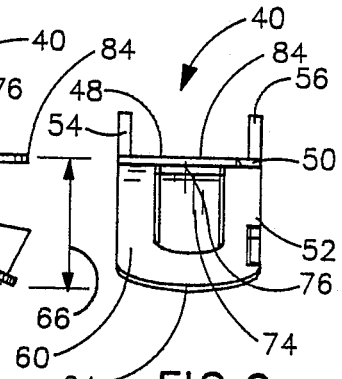
FIG. 9 is a front elevational view of the follower of FIG. 5.
Figure 10:
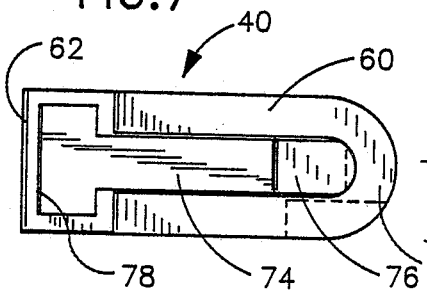
FIG. 10 is a bottom plan view of the follower of FIG. 5.
Figure 11:
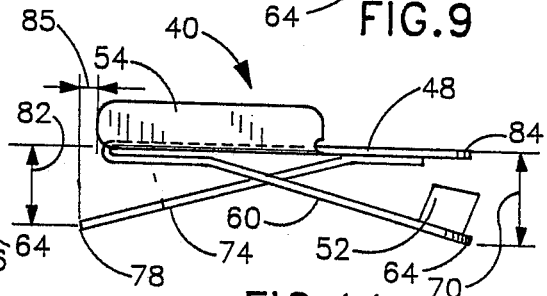
FIG. 11 is a side elevational view similar to the view of FIG. 8, but showing the follower in a collapsed configuration.
Figure 12:
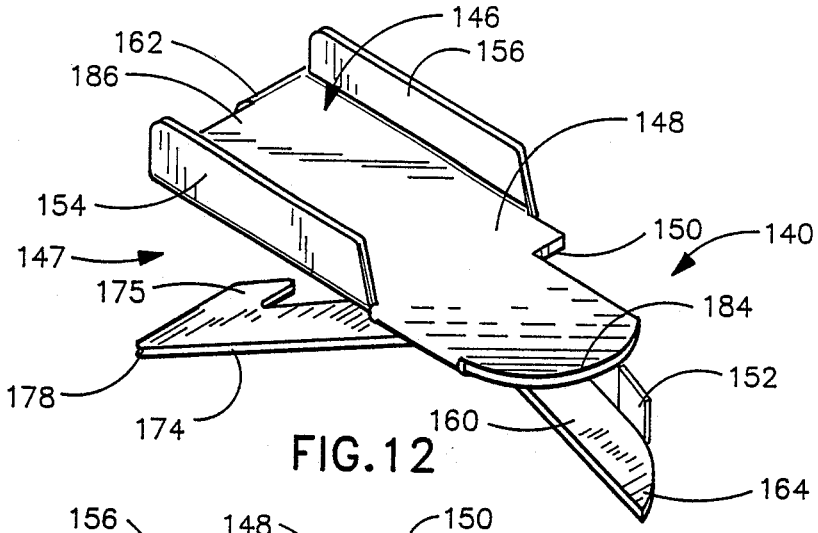
FIG. 12 is a perspective view of a second embodiment of a follower according to the present invention.
Figure 13:
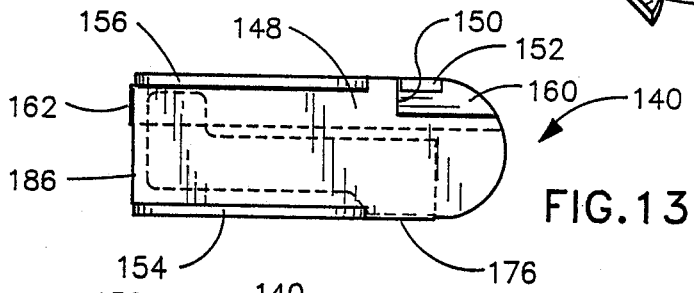
FIG. 13 is a top plan view of the follower of FIG. 12.

The total longitudinal extent of the follower is greater by a small amount 85 when the follower legs are in the collapsed configuration depicted in FIG. 11, as compared to the linear extent when the follower legs are in an expanded configuration, as depicted in FIG. 8.

The movability of the legs 60, 74 with respect to the cartridge contact surface 48 is useful because it permits the follower 40 to be folded or collapsed into the compact configuration depicted at the bottom of FIG. 3 in order to assist in providing extra space for accommodating additional cartridges 36. However, the legs must be unfolded or expanded as the follower 40 moves upward towards the opened end 22. This is at least partly because in order for the legs 60, 74 to function as intended, the free ends 64, 78 of the legs 60, 74 must be spaced a desired distance below the cartridge contact surface 48. The front leg 60 must be spaced a distance below the cartridge contact surface 48 so that when the follower 40 is in the first follower position 44, the front leg 60 can bear against the front wall 12 to prevent stripping the follower 40 from the magazine 10, as described above.

The back leg 74 must be spaced below the cartridge contact surface 48 to assist in preventing overrotation of the follower 40. As depicted in FIG. 3, the follower preferably holds the cartridges 36A–36I in a column such that the cartridge longitudinal axes are spaced and substantially parallel and at a preferred angular orientation with respect to the longitudinal axis of the magazine 10. However, if pressure is applied to a cartridge, particularly downward pressure on the nose of the uppermost cartridge, the column of cartridges tends to rotate, e.g., by moving the nose end downward. Such forces are commonly imparted to the cartridges upon removal of the uppermost cartridge by the bolt or slide. If such rotation is continued unabated, the cartridges will over-rotate, leading to jamming, i.e. impedance of the upward movement of the cartridges 36. The free end 78 of the second leg 74 is useful in reducing or eliminating over-rotation. If a force on the cartridges causes a downward force on the front or nose end 84 of the cartridge contact surface 48, the tendency will be for the nose portion 84 of the follower 40 to pivot downward about an imaginary axis which is near the rear 86 of the cartridge contact surface 48. Any such rotation, however, will cause the free end 78 of the second leg 74 to move towards the rear wall 14 and further rotation of the follower 40 will thus be arrested. For this reason, the free end 78 should be spaced a distance 80 from the cartridge contact surface 48 when the follower 40 has moved away from the second position 42.

Figure 32:
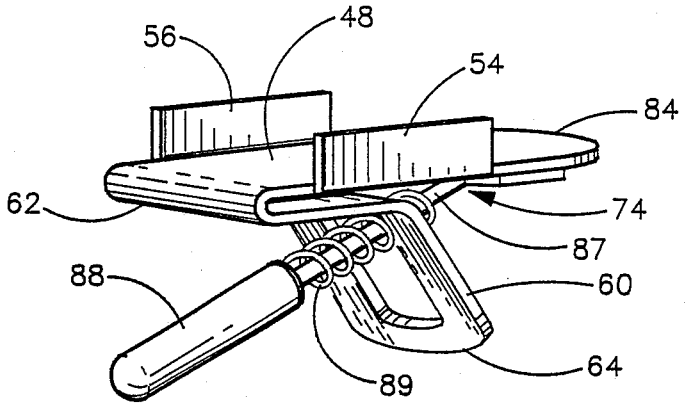
FIG. 32 is a perspective view of a follower according the the present invention depicting an alternative configuration of a follower rear leg.
Figure 33:
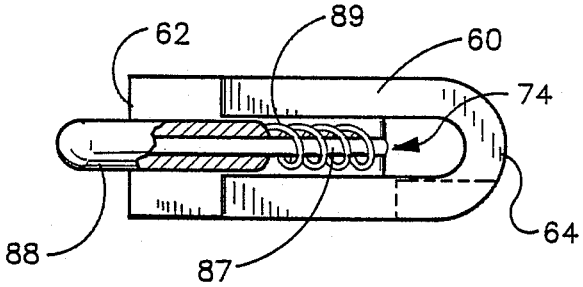
FIG. 33 is a bottom plan view of the follower of FIG. 32 with a portion of the rear leg broken away to show the interior construction.

With reference to FIGS. 32 and 33, another follower embodiment is illustrated in which rotation of the follower can be at least partly accommodated by providing a rear leg 74 that includes a rod-shaped member 87, a tube-shaped member 88 and a spring 89. The members 87, 88 are linearly collapsable. The tubeshaped member 88 fits over the end of the rod 87 and is urged in a direction towards the rear wall 14 by a spring 89. The arrangement depicted in FIGS. 32 and 33 is also useful in accommodating the slightly increased linear extent 85 when the follower 40 is in the collapsed position, as depicted in FIG. 11. Although the linearly collapsable rear leg, depicted in FIGS. 32 and 33, is illustrated in connection with the first embodiment, depicted in FIGS. 5–11, a linearly collapsible leg can also be provided in the other embodiments, depicted in FIGS. 12–31.

Figure 2:
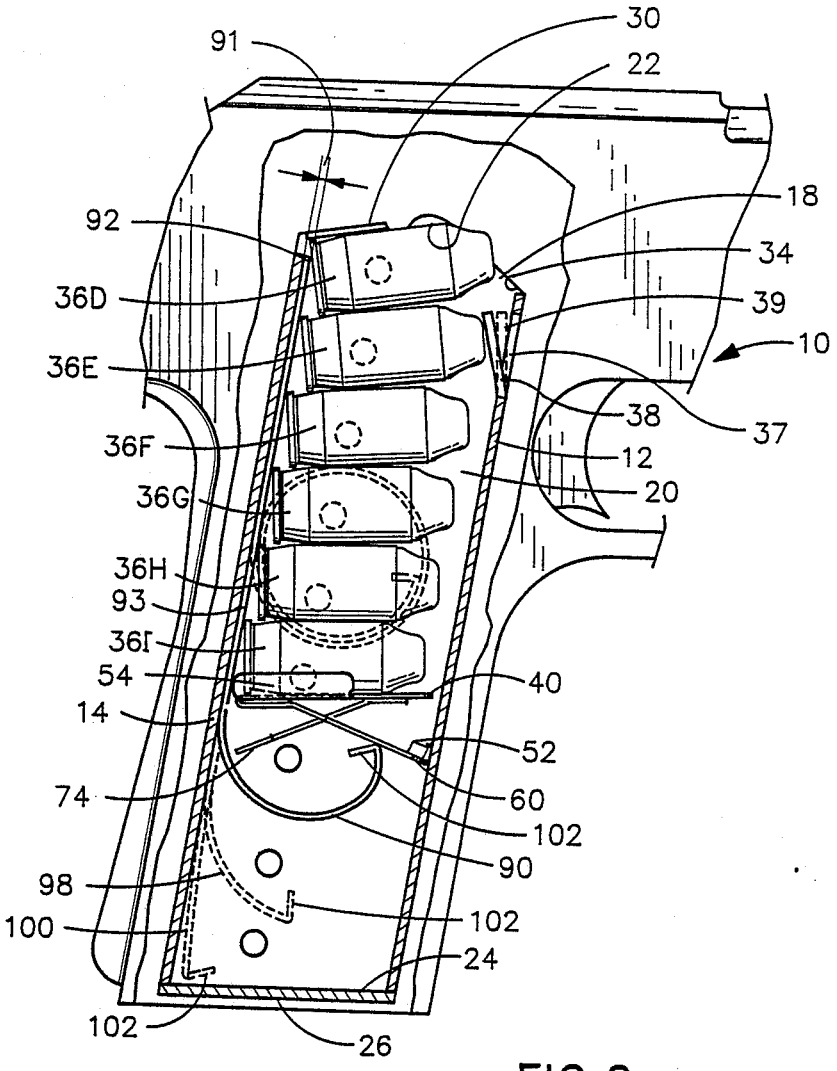
FIG. 2 is a cross-sectional view through the magazine depicted in FIG. 1 taken along line 2—2 of FIG. 1 depicting six cartridges inserted and with other configurations of the follower spring shown in phantom lines.

Returning to FIGS. 1 and 2, the leaf spring 38 attached to the front wall 12 can also be useful in resisting rotation of the cartridges and the follower. As best seen in FIG. 2, when the bolt or slide causes a nose-downward rotation of the topmost cartridge 36D, the nose portion of the cartridge 36D will contact the leaf spring 38, which will cause resistance to further rotation of the cartridge 36D and assist in preventing over-rotation thereof. The leaf spring 38 is also useful in accommodating cartridges 36A–36I, which have different configurations. The cartridges 36A–36I, depicted in FIGS. 1–3, have a flattened nose configuration and, thus, there is some amount of space between the nose end of the cartridges 36A–36I and the front wall 12. The leaf spring 38 is positioned to contact the nose portion of one or more of the cartridges such as the next-to-topmost cartridge 36E, depicted in FIG. 2. The leaf spring in this configuration acts to urge the cartridge toward the back wall 14 of the magazine 10. When cartridges having a greater longitudinal extent, such as 230 grain round nose cartridges, are used, the leaf spring 38 is deflected to assume a position 39 closer to the front wall 12 to accommodate the greater longitudinal extent of the cartridges.

It is desirable that the first and second legs 60, 74 be moved from the second or collapsed leg positions, depicted in FIG. 11, towards the first or expanded leg positions, depicted in FIG. 8, as the follower moves away from the second follower position 42 and towards the opened end 22. It is preferred to produce this movement of the first and second legs 60, 74 towards the first position by springs. Springs are beneficial not only because they act to move the first and second legs 60, 74 to the unfolded or expanded configuration but also because the energy stored in the springs in the compressed state of the follower can be used to assist in lifting the cartridges, and particularly in lifting cartridges as the first cartridge 36A is removed from the magazine 10, as more fully described below.

In the embodiment depicted in FIGS. 5–25, the spring used to move the legs is the resiliency or springiness of the legs themselves. Because the first and second legs 60, 74 are attached only at one end 62, 76 and have a free end 64, 78 angled downward therefrom, the legs themselves 60, 74 act as leaf springs which store energy when they are compressed by movement into the second position, depicted in FIG. 11, and release energy when they move towards the first position, depicted in FIG. 8. When the first leg 60 is a leaf spring, as described above, the leg 60 must at least have sufficient resiliency that the bolt/slide hold-open 52 can move the bolt/slide hold-open lever (not shown) rather than conversely.

Another spring configuration which can be used to assist in lifting the follower from the second position 42 is depicted in FIG. 4. In this embodiment, a leaf spring 89 is attached in the vicinity of the bottom wall 26 and is configured to urge the follower 40 upwards as the first and/or second cartridge 36A, 36B are removed from the magazine 10. Preferably, the leaf spring 89 is collapsed or folded against the bottom wall 26 when the follower 40 is in the second position 42 so as to take up a small amount of space below the follower 40.

Referring again to FIG. 1, a spring 90 is provided for use in moving the follower 40 upwards through the magazine 10 towards the opened end 22 of the magazine 10. The spring 90 has a thickness 91 and is preferably of a type which provides a substantially constant effective force at any of the follower positions. This type of spring is commonly known as a "conforce" spring. One type of conforce spring is described in the Hopkins patent discussed above, although there are other types of conforce springs. As depicted in FIG. 2, the spring 90 has a first end 92 attached to the magazine 10. The first end 92 is preferably attached to an interior surface of the second end wall 14, such as by welding, riveting or the like. The spring 90, in its relaxed or unstressed condition, conforms itself to a spiral shape which defines a generally circular perimeter, as depicted in FIGS. 2–4. When the follower 40 is in the second position 44 near the opened end of the magazine 22, the major portion of the spring 90 is in a spiral configuration which bears against the follower 40 such as by bearing against the bottom surfaces of the first and second legs 60, 74, as depicted in FIG. 4. As cartridges 36 are inserted into the magazine 10, the follower 40 is forced downward from the first position 44 towards the second position 42. As a consequence of this downward movement of the follower 40, the spring 90 uncoils to take on the successive positions shown in phantom in FIG. 4. As best seen in FIG. 1, as the spring 90 uncoils, the uncoiled portion 93 lies substantially flat against the interior surface of the rear wall 14 and the rear surfaces of the cartridges 36A–36I lie adjacent to the uncoiled portion 93 of the spring 92. FIG. 4 depicts, in phantom lines, the configuration of the spring 90 after loading, respectively, five 94, seven 96, eight 98, and nine 100 cartridges into the magazine 10. The configuration after loading five cartridges 94 is such that the spring 90 has about $1\frac{1}{2}$ spiral revolutions. The configuration after seven cartridges have been loaded 96 is such that the spring 90 has been uncoiled so that only about $\frac{1}{2}$ of a spiral revolution lies below the follower. The configuration after eight cartridges have been loaded 98 is such that only about $\frac{1}{4}$ of a spiral revolution resides below the follower 40. The configuration of the spring 90 after nine cartridges have been loaded 100 is such that the entire length or nearly the entire length of the spring 90 has been uncoiled and lies flat against the rear wall 14.

In order to accommodate at least one extra cartridge in the magazine 10 as compared to the number of cartridges accommodated in previous magazines, the vertical distance which the spring 90 occupies below the follower 40, such as below the cartridge contact surface 48 of the follower, is less than a diameter of a cartridge. Preferably, the spring extends substantially less than a cartridge diameter, such as less than a cartridge radius. It is preferred that the spring extend below the follower legs a distance equal to only a few or, most preferably, about one thickness 91 of the spring 90.

It has been found that when the spring 90 is of such a length that it is substantially "run out" when the follower is in the lowest position 42 (i.e. such that substantially the entire length of the spring 90 lies against the rear wall 14), the spring 90 often may not provide sufficient effective force to lift the column of cartridges 36B–36I as the first cartridge 36A is removed from the magazine 10. Without wishing to be bound by a theory, it is believed that this insufficiency is at least partly due to the spring 90 being positioned so that it imparts a force which is at an angle to the longitudinal axis of the magazine 10, such as being substantially perpendicular thereto, rather than being directed upwards towards the opened end 22. For this reason, an energy storage device, such as a second spring, is provided to assist in moving the follower 40 away from the second follower position 42 towards the opened end 22.

In the preferred embodiment, the spring which performs this function is the same spring which moves the follower legs 60, 74 from the second position adjacent the follower to the first position at an angle to the follower. As discussed above, when the follower is moved into the second position 42, the legs 60, 74 are moved towards the cartridge contact surface 48 against the urging of the leg springs, such as the leg leaf springs. In so doing, energy is stored in the legs 60, 74. When the first bullet 36A is removed from the magazine 10, the energy stored in the legs 60, 74 is released so that the legs 60, 74 bear against the bottom surface 26 of the magazine 10 and assist in lifting the cartridge contact surface 48 upwards towards the opened end 22 of the magazine 10. Because the follower 40 is now in a position lifted away from the second position 42 and because the weight of only eight cartridges 36B–36I must now be supported, the spring 90 is able to move at least partly underneath the follower 40, such as to the position 98 depicted in FIG. 4. Because the configuration of the spring when eight cartridges are present 98 is such that the spring 90 is partly underneath the follower 40, the force of the spring is more nearly directed towards the opened end 22. This fact, combined with the fact that the weight of a fewer number of bullets must now be supported, permits the spring 90, possibly assisted by some residual resiliency in the legs 60, 74, to lift the follower as subsequent cartridges 36B–36I are serially removed from the magazine 10.

With further reference to FIGS. 1–5, a second difficulty which has been found in moving the spring from the nine cartridge position 100 to the eight cartridge position 98 is that the spring may not easily direct itself underneath the follower 40 into the desired spiral configuration. In particular, the end of the spring 90 may move to a position between the free end 64 of the front leg 60 and the nose end 84 of the cartridge contacting surface 48 (see FIG. 5), rather than moving to a position below the legs 74, 60 as desired. To assist in avoiding this problem, the free end of the spring 90 is provided with a tip 102 projecting approximately perpendicular to the length of the spring 90. The tip 102 can be formed by merely bending the end of the spring 90 at an approximate right angle or can be a separate piece attached to the spring 90. As seen in FIG. 3, when the follower is in the lowest position 42, the tip 102 of the spring 90 projects underneath the follower 40 and particularly underneath the free end 78 of the rear leg 74, thus assisting in guiding the spring to the desired position underneath the follower as the follower moves from the second position 42 towards the opened end 22. The tip 102 can also assist in at least partly directing the force of the spring 102 in a direction towards the opened end 22, particularly as the spring 90 contacts the front leg 60, such as during removal of the second cartridge 36B.

A follower, according to the present invention, can be provided in a number of configurations. Four embodiments for followers usable in connection with the present invention are depicted in FIGS. 5–11 (first follower embodiment), 12–18 (second follower embodiment), 19–25 (third follower embodiment) and 26–31 (fourth follower embodiment), respectively. All embodiments depicted share a number of aspects and functions as described below. Embodiments 1 (FIGS. 5–11), 2 (FIGS. 12–18) and 3 (FIGS. 19–25) function in similar fashions and differ principally in the configuration and construction of the legs. The first embodiment, depicted in FIGS. 5–11, has already been described in connection with the manner in which the follower 40 fits into and moves through the magazine 10 and the manner in which the follower 40 changes configuration and assists in lifting cartridges 36. The follower according to the second embodiment, depicted in FIGS. 12–18, functions in a fashion similar to the first embodiment. The second embodiment includes an upper structure 146 for supporting a cartridge 36I and a lower structure 147. The upper structure 146 includes a cartridge contact surface 148 which contacts the lowermost cartridge 36I. The lower structure 147 is that part of the follower which is below the points where the legs 160, 174 are attached. Cartridge contact surface 148 is provided with a cut-out region 150. This cut-out 150 provides for clearance of the cartridge contact surface 148 as it moves upward past the bolt or slide hold-open lever of the firearm (not shown).

A bolt/slide hold-open 152 is attached to the follower 140, preferably to the front leg 160 of the follower 140, or formed by bending a portion of the cartridge contact surface, as depicted in FIGS. 34 and 35, to be positioned directly below the cut-out 150 of the cartridge contact surface 148. The hold-open 152 is attached in a position to activate the bolt hold-open lever of the firearm (not shown) when the follower 140 moves to the second position 44.

Extending upward from the cartridge contact surface 148 are first and second ears 154, 156. The ears 154, 156 are located on the cartridge contact surface 148 in a position such that when the follower approaches the first position 44, shown in FIG. 4, the ears 154, 156 will contact the lips 28, 30, respectively, of the magazine 10. An ear height 58 of about ½ to ⅓ the diameter of a cartridge 36 will be effective to properly position the front leg 160 with respect to the escape opening 34.

The front leg 160 has a first end 162 which is attached to the upper structure 146. In the embodiment shown in FIG. 12, the first end 162 is continuous and integral with the upper structure 146 and is formed by bending the front leg 160 from an originally flat configuration. The front leg 160 has a second or free end 164. The front leg 160 is movable with respect to the upper structure 146, from a position such as that shown in FIG. 15, in which the free end 164 of the front leg 160 is spaced a distance 66 from the cartridge contact surface 148 to a second position illustrated in FIG. 18. In the second position, the front leg 160 is substantially adjacent to the cartridge contact surface 148 and the free end 164 of the front leg 160 is positioned a second distance 70 away from the cartridge contact surface 148. The second distance 70 is less than the first distance 66.

A second or rear leg 174 has a first end 176 attached to the upper structure 146 and a free end 178. In the embodiment depicted in FIGS. 12–18, the first end 176 is continuous and integral with the upper structure 146 and is formed by bending the rear leg 174 from an originally flat configuration. The second leg 174 is movable from a first leg position illustrated in FIG. 15 in which the free end 178 is spaced a distance 80 from the cartridge contact surface 148 to a second position substantially adjacent the cartridge contact surface 148, illustrated in FIG. 18. When the second leg 174 is in the second position, shown in FIG. 18, the free end 178 of the second leg 174 is spaced a distance 82 from the cartridge contact surface 148. The distance 82 is less than the distance 80.

Figure 14:
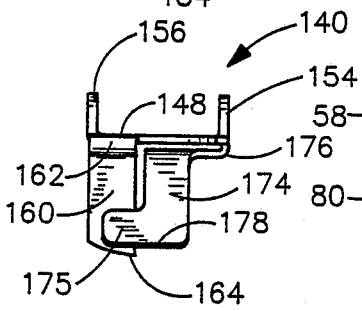
FIG. 14 is a rear elevational view of the follower of FIG. 12.
Figure 15:
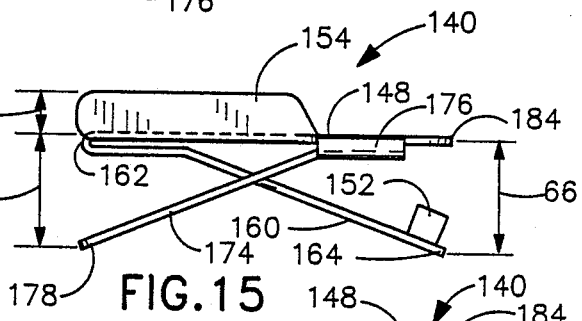
FIG. 15 is a side elevational view of the follower of FIG. 12.
Figure 16:
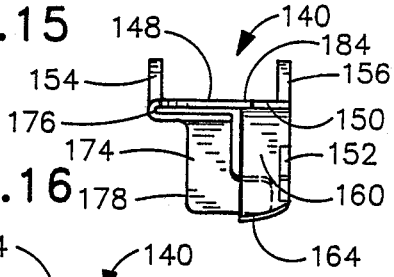
FIG. 16 is a front elevational view of the follower of FIG. 12.
Figure 17:
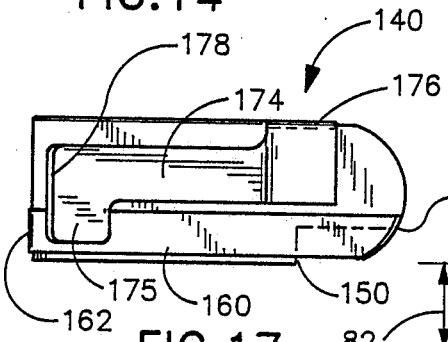
FIG. 17 is a bottom plan view of the follower of FIG. 12.
Figure 18:
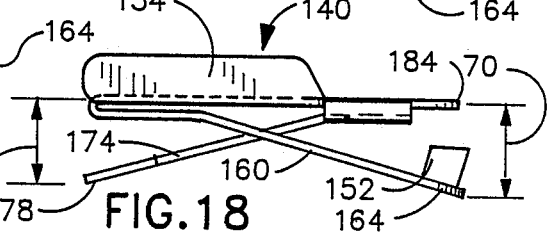
FIG. 18 is a side elevational view similar to FIG. 15 but showing the follower in a collapsed configuration.
Figure 19:
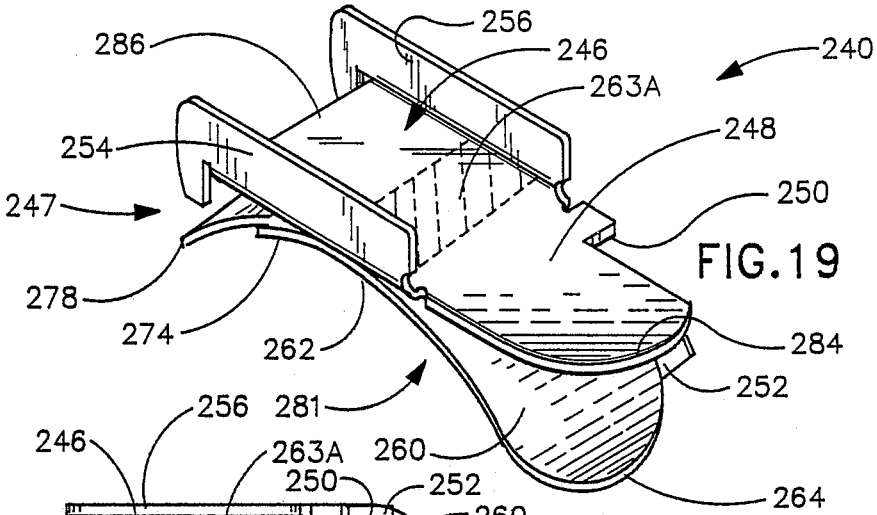
FIG. 19 is a perspective view of a third embodiment of a follower according to the present invention.
Figure 20:
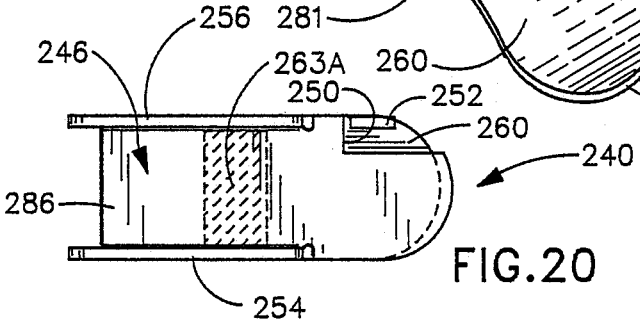
FIG. 20 is a top plan view of the follower of FIG. 19.
Figure 21:
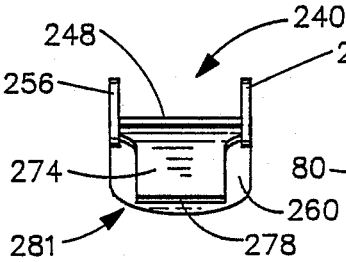
FIG. 21 is a rear elevational view of the follower of FIG. 19.
Figure 22:
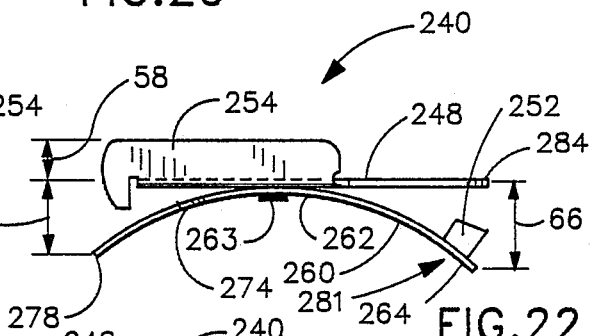
FIG. 22 is a side elevational view of the follower of FIG. 19.
Figure 23:
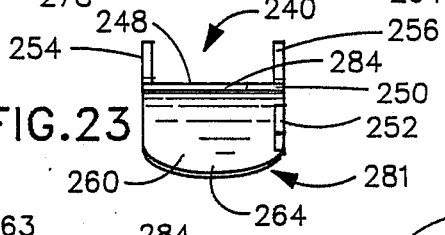
FIG. 23 is a front elevational view of the follower of FIG. 19.
Figure 24:
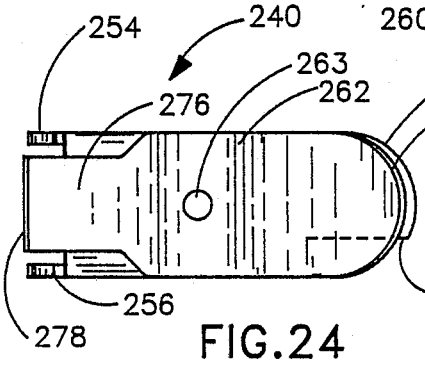
FIG. 24 is a bottom plan view of the follower of FIG. 19.
Figure 25:
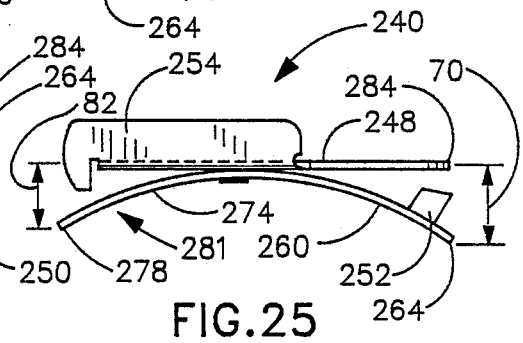
FIG. 25 is a side elevational view similar to FIG. 22 but showing the follower in a collapsed configuration.

As best seen in FIGS. 14, 16 and 17, the first leg 160 is laterally spaced from the second leg 174. Preferably, a foot 175 is attached to the second leg 174 and extends laterally towards a portion of the first leg 160. The foot 175 is useful in stabilizing the follower 140 against overrotation and in providing a surface which the spring 90 can reside under when the follower 140 is in the lowest position 42.

As depicted in FIGS. 19–25, a follower 240 according to a third embodiment includes an upper structure 246 for supporting a cartridge 36I and a lower structure 247. The upper structure 246 includes a cartridge contact surface 248 which contacts the lower most cartridge 36I. The lower structure 247 is that part of the follower which is below the points where the legs 260, 274 are attached. The cartridge contact surface 248 is provided with a cut-out area 250. This cut-out area 250 provides for clearance of the cartridge contact surface 248 as it moves upward past the bolt or slide hold-open lever of the firearm (not shown).

A bolt/slide hold-open 252 is attached to the follower 240, preferably being attached to the front leg 260 of the follower 240, or formed by bending a portion of the cartridge contact surface 248, generally as depicted in FIGS. 34 and 35, to be positioned directly below the cut-out 250 of the cartridge contact surface 248. The hold-open 252 is attached in a position to activate the bolt hold-open lever of the firearm (not shown) when the follower 240 moves to the first position 44.

Extending upward from the cartridge contact surface 248 are first and second ears 254, 256. The ears 254, 256 are located on the cartridge contact surface 248 in a position such that when the follower approaches the first position 44, shown in FIG. 4, the ears 254, 256 will contact the lips 28, 30, respectively, of the magazine 10. An ear height 58 of about ½ to ⅓ the diameter of a cartridge 36 will be effective to properly position the front leg 260 with respect to the escape opening 34.

The front leg 260 has a first end 262 which is attached to the upper structure 246. The front leg 260 has a second or free end 264. The front leg 260 is movable with respect to the upper structure 246, from a position such as that shown in FIG. 22 in which the free end 264 of the front leg 260 is spaced a distance 66 from the cartridge contact surface 248 to a second position, illustrated in FIG. 25. In the second position, the front leg 260 is substantially adjacent to the cartridge contact surface 248 and the free end 264. The front leg 260 is positioned a second distance 70 away from the cartridge contact surface 248. The second distance 70 is less than the first distance 66.

A second or rear leg 274 has a first end 276 attached to the upper structure 246 and a free end 278. The second leg 274 is movable from a first position illustrated in FIG. 22 in which the free end 278 is spaced a distance 80 from the cartridge contact surface 248, to a second position substantially adjacent the cartridge contact surface 248, illustrated in FIG. 25. When the second leg 274 is in the second position, shown in FIG. 25, the free end 278 of the second leg 274 is spaced a distance 82 from the cartridge contac surface 248. The distance 82 is less than the distance 80.

In the third embodiment, depicted in FIGS. 19–25, the first and second legs 260, 274 are portions of a single acuate leaf 281. The first leg 260 comprises a first portion of the arcuate leaf 281 and the second leg 274 comprises a second portion of the arcuate leaf 281. The arcuate leaf 281 is attached to the upper structure 246 between the first portion and the second portion, preferably by means of a rivet 263. The arcuate leaf 281 can also be attached by other methods such as welding, e.g. in a central area 263A of the cartridge contact surface 248.

As illustrated in FIGS. 26–31, a follower 340 according to a fourth embodiment, includes an upper structure 346 for supporting a cartridge 36I and a lower structure 347. Extending downward from the periphery of the cartridge contact surface 348 is a skirt 349. The skirt 349 is useful in providing stabilization of the follower 340 against over-rotation and in preventing stripping out of the follower 340 from the magazine 10. Unlike the legs of the follower embodiments 1-3 described above, the skirt 349 is not necessarily collapsable or foldable, and thus represents a minimum volume which must be provided underneath the cartridge contact surface 348 when the follower 340 is in the lowest position 342. Therefore, in connection with the fourth embodiment of the follower 340, the entire space which is used to accommodate an additional cartridge in the magazine 10 must be achieved by virtue of runout of the spring 90, as described above. A portion of the skirt 349 is provided with a concave contour to define a cut-out 350. The cut-out 350 provides for clearance of the cartridge contact surface 348 as it moves upward past the bolt or slide hold-open lever of the firearm (not shown).

A bolt/slide hold-open 352 is provided in the form of a ledge underneath the cut-out 350. The hold-open 352 is provided in a position to activate the bolt hold-open lever of the firearm (not shown) when the follower 340 moves to the first position 44.

Extending upward from the cartridge contact surface 348 are first and second ears 354, 356. The ears 354, 356 are located on the cartridge contact surface 348 in a position such that when the follower approaches the first position 44, shown in FIG. 4, the ears 354, 356 will contact the lips 28, 30, respectively, of the magazine 10. An ear height 58 of about ½ to ⅓ the diameter of a cartridge 36 will be effective to properly position the front leg 360 with respect to the cut-out 34. The cartridge contact surface 348 and the ears 354, 356 are curved to provide a concave surface for cradling the lowermost cartridge 36I.

A leg 360 has a first end 362 which is pivotally attached to the upper structure 346 such as by a pin 361. The leg 360 is movable with respect to the upper structure 346, from a position such as that shown in FIG. 31 in which the free end 364 of the leg 360 is spaced a distance 66 from the cartridge contact surface 348 to a second position, illustrated in FIG. 30. In the second position, the front leg 360 is substantially adjacent to the cartridge contact surface 348 and the free end 364 of the leg 360 is positioned a second distance 70 away from the cartridge contact surface 348. The second distance 70 is less than the first distance 66. Unlike follower embodiments 1–3 described above, the leg 360 of the follower 340 is urged towards the first leg position depicted in FIG. 31 by a spring 371 which extends between a portion of the leg 360 and the cartridge contact surface 348. Preferably, one end of the spring 371 is seated in a cup-shaped spring seat 375 of the leg 360, and the other end of the spring 371 surrounds a post 377 which extends downward from the bottom of the cartridge contact surface 348. The leg 360 can be provided with an arched surface 379 to accommodate the follower spring 90 as it winds into the preferred spiral configuration underneath the follower 340.

The manner of operation and method of use of the magazine 10 according to the present invention will now be described. A first cartridge 36I is inserted into the magazine 10 through the opened end 22 in the normal manner by pushing the rim portion of the cartridge 36I through the opened end 22 in the region forward of the lips 28, 30, then pushing the rim portion under the lips 28, 30 and toward the rear wall 14. Insertion of the first cartridge 36I moves the follower 40 downward through the magazine 10 from the uppermost position depicted in FIG. 4. As the follower 40 moves downward, it forces the follower spring 90 to unroll and the unrolled portion 93 will lie flat against the second or back end wall 14. As the second through eighth cartridges 36H–36B are inserted through the opened end 22, the follower spring 90 further unrolls to take on the successive configurations depicted in FIG. 4 after five cartridges have been inserted 94, after seven cartridges have been inserted 96, and after eight cartridges have been inserted 98. When the ninth cartridge 36A is inserted, the follower 40 is forced downward against the bottom plate 26 of the magazine 10 to take on the collapsed or folded configuration depicted in FIG. 3. This folding or collapsing of the follower legs 60, 74 causes a stressing or loading of the legs 60, 74 and stores energy therein. The follower spring 90 is substantially run out, i.e., substantially all of the follower spring 90, i.e., at least ⅓ of the length of the spring 90, preferably at least 80 percent of the spring 90, is unwound and lies flat against the rear wall 14. The tip 102 of the spring 90 extends underneath the follower 40 and preferably underneath the free end 78 of the rear leg 74 of the follower 40.

The fully-loaded magazine 10 is then inserted into the firearm. Operation of the firearm removes cartridges serially through the opened end 22 of the magazine 10. When the first cartridge 36A is removed, the energy stored in the folded or collapsed legs 60, 74 is released. The legs 60, 74 bear against the bottom plate 26 of the follower 40 and thus lift the cartridge contact surface 48 of the follower 40 upward towards the opened end 22 of the magazine 10, thereby lifting the column of cartridges 36I–36B such that the topmost cartridge 36B lies adjacent the opened end 22 of the magazine 10. In this manner, the legs 60 and/or 74 are used to assist in moving the follower 40 from the lowermost position 42 towards the opened end 22 of the magazine 10. The spring 90 partially curves underneath the magazine 10 to assume the position 98 depicted in FIG. 4.

Further use of the firearm removes the second through eighth cartridges 36B–36H in a serial fashion. Removal of each cartridge by operation of the firearm bolt or slide causes downward pressure on the column of cartridges 36 and particularly on the nose portion of the cartridges. Such downward pressure causes the free end 78 of the rear leg 74 to bear against the second or back wall 14 of the magazine 10 and to partially cause the front end 84 of the follower 40 to bear against the front wall 12 of the magazine 10. In this manner, overrotation of the follower 40 and cartridges 36 is prevented. As the follower 40 moves upward through the magazine 10, the cartridge contact surface 48 of the follower 40 clears the bolt/slide hold-open lever of the firearm (not shown) because of the position of the cutout area 50. As the last cartridge 36I is removed from the magazine 10, the follower 40 moves to the uppermost position 44 depicted in FIG. 4. The ears 54, 56 contact the lips 28, 30 of the magazine 10 and prevent further upward movement of the follower 40. In this manner, the front portion 64 of the front leg 60 is positioned to lie below the escape opening 34 in the front wall 12 to prevent stripping of the follower 40 from the magazine 10.

As will be clear to those in the art, a number of variations and modifications of the embodiments described can also be practiced. One or both of the concepts of runout of the spring 90 and collapsable follower legs 60 and/or 74 can be used in magazines intended for firearms other than 0.45 firearms and can be used to provide for a magazine which is capable of holding a greater number of cartridges than the maximum number of cartridges held in a magazine of existing design for the same firearm. Particularly, one or both of the two concepts can be used to provide for increasing the number of stored cartridges without changing the external magazine configuration in cartridges having two or more columns and/or intended for hand guns other than a 0.45 or for rifles or other types of firearms. The advantage of providing an increased number of cartridges can be obtained using only the concept of the runout of the conforce spring 90 and not using the concept of a collapsable leg. The advantage can also be provided using only the concept of a collapsable leg and not using the concept of the runout of the conforce spring. The leg or legs can be in a number of configurations including Z-shaped leaf springs, coil springs, lateral rather than longitudinally oriented legs, or three or more legs. The follower spring 90 can provide a force which is not precisely constant, such as a linearly or non-linearly increasing or decreasing force. The devices for holding the follower a predetermined distance from the opened end 22 can be provided or attached in ways other than being attached to the follower, such as being attached to an interior surface of the magazine 10. The conforce spring can be oriented to uncoil against a side wall rather than end wall. Two or more follower springs 90 can be provided. The follower spring tip 102 can be replaced or supplemented with other spring configurations or guide means, such as a guideway in the follower 40.

The followers, according to the first two embodiments, are of a configuration such that they can be easily formed from a single flat sheet, such as sheet metal, by cutting and folding the sheet. The first and third embodiments depicted in FIGS. 5–11 and 19–25, respectively, can be formed by joining together two pieces which are formed from flat sheets by riveting or welding and the like. The fourth follower embodiment depicted in FIGS. 26–32 can be conveniently formed by injection molding two plastic pieces and joining them using a pin 36I. The follower embodiments depicted and other modifications and variations thereof can be formed by any convenient method known in the art, including casting, stamping, and molding. Although the followers depicted include a spring means for storing force, in addition to the follower spring 90, the second spring means for storing force can be separate and not part of the follower, e.g. as part of the bottom wall 26.

Although the present invention has been described with reference to certain embodiments, it should be appreciated that further modifications can be effected within the spirit and scope of the invention.

What is claimed is:

1. A magazine for holding cartridges, each having a diameter, comprising:

first and second end walls and first and second side walls defining a chamber having a bottom end and an opened end;

a follower comprising a cartridge support having a cartridge contact surface and mounted in said chamber for movement between a first follower position adjacent to said opened end and a second follower position adjacent to said bottom end;

means for moving said follower from said second to said first position, said means for moving having a portion extending below said cartridge contact surface, wherein the distance said moving means extends below said cartridge contact surface is less than about the diameter of each of the cartridges when said follower is in said second follower position; and a first leg and a second leg attached to said cartridge support, each leg having a free end spaced from said cartridge support, wherein said means for moving is movable with respect to each of said free ends of said first and second legs.

2. A cartridge magazine, as claimed in claim 1, wherein:

said means for moving said follower comprises a conforce spring having thickness, wherein the distance said means for moving extends below said follower is less than about said thickness when said follower is in said second follower position.

3. A magazine, as claimed in claim 1, wherein:

said means for moving comprises a conforce spring having a first end fixed with respect to one of said first and second end walls of the magazine and a free end, said free end having a tip projecting at an angle therefrom.

4. A follower for a cartridge magazine, comprising:

means for supporting a cartridge having a cartridge contact surface;

a first leg and a second leg attached to said cartridge supporting means, each leg having a free end movable from a first leg position below and spaced from said cartridge contact surface and a second leg position substantially adjacent to said cartridge supporting means; and means for moving said means for supporting wherein said means for moving is movable with respect to each of said free ends of said first and second legs.

5. A follower, as claimed in claim 4, further comprising:

means for urging at least one leg towards said first leg position.

6. A follower, as claimed in claim 4, wherein:

at least one of said first leg and said second leg is resiliently attached to said cartridge supporting means for biasing towards said first leg position.

7. A follower, as claimed in claim 4, further comprising:

at least one ear extending upward from said cartridge contact surface.

8. A follower, as claimed in claim 4, wherein:

said first leg is laterally spaced from said second leg.

9. A follower, as claimed in claim 8, further comprising:

a foot attached to said second leg, at least a portion of said foot extending laterally towards a portion of said first leg.

10. A follower for a cartridge magazine, comprising:

means for supporting a cartridge having a cartridge contact surface;

a first leg and a second leg attached to said cartridge supporting means, each leg having at least a portion movable from a first leg position below and spaced from said cartridge contact surface and a second leg positioned substantially adjacent to said cartridge supporting means, wherein said first leg comprises a first portion of an arcuate leaf;

said second leg comprises a second portion of said arcuate leaf, and said arcuate leaf is attached to said cartridge supporting means between said first portion and said second portion.

11. A follower for a cartridge magazine, comprising:

means for supporting a cartridge having a cartridge contact surface;

a first leg and a second leg, each leg attached to said cartridge supporting means, each leg having at least a portion movable from a first leg position below and spaced from said cartridge contact surface and a second leg position substantially adjacent to said cartridge supporting means, wherein said first leg contains a longitudinal slot; and a portion of said second leg passes through said longitudinal slot.

12. A follower for a cartridge magazine, comprising:

means for supporting a cartridge having a cartridge contact surface;

a first leg and a second leg attached to said cartridge supporting means, each leg having at least a portion movable from a first leg position below and spaced from said cartridge contact surface and a second leg position substantially adjacent to said cartridge supporting means; and a tab extending upward from at least one of said first and said second legs positionable to contact a firearm boltopen mechanism when said magazine is inserted in a firearm.

13. A magazine for holding cartridges, each having a diameter, comprising:

first and second end walls and first and second side walls defining a chamber having a floor end and an opened end;

a follower having a cartridge contact surface and mounted in said chamber for movement between a first follower position adjacent to said opened end and a second follower position adjacent to said floor end;

a first leg pivotally attached to said follower for movement between a first leg position at an angle to said follower and a second leg position substantially adjacent to said follower said first leg having a free end;

a second leg attached to said follower and having a free end;

means for urging said first leg toward said first leg position, wherein said first leg is moved against the urging of said means for urging when said follower is moved to said second follower position; and a conforce spring having a length and a thickness for moving said follower from said second follower position to said first follower position, wherein less than one-third of the length of said spring resides below said follower when said follower is in said second follower position and wherein said spring is movable with respect to said first leg free end and said second leg free end.

14. A follower for a cartridge magazine, comprising:

a cartridge holding means having a cartridge contact surface;

a leg pivotally attached to said cartridge holding means for movement between a first leg position below and at an angle to said cartridge holding means and a second leg position substantially adjacent to said cartridge holding means; and biasing means extending between a portion of said leg and said cartridge holding means for urging said leg towards said first leg position.

15. A method for inserting and removing cartridges having a diameter from a magazine having a bottom end and an opened end, comprising:

providing a follower in said magazine movable between a first follower position adjacent to the opened end and a second follower position adjacent to the bottom end, having first and second legs, each having a free end and each movable between a first leg position at an angle to said follower and a second leg position adjacent to said follower, with means for urging one of said first legs and said second leg towards said first leg position;

providing means for moving said follower in a direction towards said first follower position;

inserting at least one cartridge through said opened end to move said follower to said second follower position;

permitting one of said first leg and said second leg to move towards said second leg position, when said follower is in said second follower position, wherein said means for moving extends below said follower a distance less than the diameter of the cartridge;

removing a cartridge from said magazine; and using one of said first leg and said second leg to assist in moving said follower in a direction towards said first follower position, wherein said one leg moves towards said first leg position and wherein said means for moving moves with respect to said free ends of said first and second legs.

16. A magazine for holding cartridges, comprising:

first and second end walls and first and second side walls defining a chamber having a bottom end and an opened end;

a follower having a cartridge contact surface and a lower structure extending below said cartridge contact surface and comprising first and second legs each having a free end, said lower structure being movable between a first configuration having a first height and a second configuration having a second height, said second height being greater than said first height, said follower mounted in said chamber for movement between a first follower position adjacent to said opened end and a second follower position adjacent to said bottom end, said follower including means for storing energy and for releasing said stored energy for use in moving said follower from said second follower position in a direction towards said first follower position; and spring means for moving said follower in a direction towards said first follower position, wherein said spring means is different from said means for storing energy and wherein said spring means is movable with respect to said first and second leg free ends.

17. A method for moving cartridges in a cartridge magazine, each cartridge having a diameter, the magazine having a bottom end and an opened end, comprising:

providing a follower in said magazine having first and second legs, each having a free end movable between a first leg position adjacent to the opened end and a second leg position located a predetermined distance from the bottom end, with means for storing energy and releasing said stored energy, said predetermined distance being less than about the diameter of each of the cartridges;

providing means for moving said follower in a direction towards a first follower position wherein said means for moving is movable with respect to said free ends of said first and second legs;

inserting at least one cartridge through said opened end to move said follower towards a second follower position; and releasing said stored energy from said means for storing energy to use in moving said follower from said second follower position in a direction towards said first follower position.

18. A method, as claimed in claim 17, wherein at least said first leg is movable from a first leg position to a second leg position; and said means for storing energy comprises spring means wherein energy is stored in said spring means when said first leg is moved in a direction towards said second leg position.

19. A follower for a cartridge magazine having front and rear walls, comprising:

means for supporting a cartridge having a cartridge contact surface;

first and second legs each having a first end attached to the follower and a free end;

said first leg being movable with respect to said means for supporting a cartridge from a first leg position wherein said first leg free end is adjacent to said front wall and is located a first distance below said cartridge contact surface, and a second leg position in which said free end is located a second distance below said cartridge contact surface, said second distance being less than said first distance; and said second leg being movable between a third leg position wherein said second leg free end is adjacent said rear wall and is positioned a third distance below said cartridge contact surface, and a fourth leg position wherein said free end is located at a fourth distance below said cartridge contact surface, said fourth distance being less than said third distance.

20. A magazine for holding cartridges, comprising:

first and second end walls and first and second side walls defining a chamber having a bottom end and an opened end, at least one lip member partially extending over said opened end, said first end wall having a cut-out portion for removing bullets from said magazine;

a follower mounted in said chamber for movement between a first position adjacent to said opened end and a second position spaced from said opened end, said follower having a leg with a first end attached to the follower and a free end, said free end being adjacent to said first end wall; and means for preventing movement of said follower closer than a predetermined distance to said opened end wherein said free end of said leg is positioned below said cut-out portion when said follower is said predetermined distance from said opened end.

21. A magazine, as claimed in claim 20, wherein:

said means for preventing movement comprises at least one ear extending upward from said follower in a position to contact said lip when said follower moves towards said opened end.

* * * * *